US005626041A

United States Patent [19]

Zaccaria

[11] Patent Number: 5,626,041

[45] Date of Patent: May 6, 1997

[54] LOCK CYLINDER REPLACEMENT DEVICE AND METHOD OF REPLACING LOCK CYLINDER WITH LOCK CYLINDER REPLACEMENT DEVICE

[76] Inventor: James M. Zaccaria, 9 Shoredale Dr., Manhasset, N.Y. 11030

[21] Appl. No.: 442,659

[22] Filed: May 17, 1995

[51] Int. Cl.[6] ..... E05B 9/08

[52] U.S. Cl. ..... 70/370; 70/373; 70/375; 70/DIG. 81

[58] Field of Search ..... 70/370, 229, 231, 70/371, 373, 375, DIG. 85; 411/366, 368, 399, 328, 329, 377, 431

[56] References Cited

U.S. PATENT DOCUMENTS

| | | | |
|---|---|---|---|
| 381,463 | 4/1888 | Cook | 411/366 |
| 659,484 | 10/1900 | Lockwood | 70/370 |
| 1,591,862 | 6/1926 | Rontgen | 411/366 |
| 3,448,599 | 6/1969 | Schreiber | 70/404 |
| 3,503,233 | 3/1970 | Russell et al. | 70/370 |
| 4,316,690 | 2/1982 | Voller | 411/377 |
| 4,482,278 | 11/1984 | Dorn | 411/377 |
| 4,507,035 | 3/1985 | Monett | 411/377 |
| 4,518,182 | 5/1985 | Cousin et al. . | |
| 4,565,080 | 1/1986 | Kincaid et al. | 70/215 |
| 4,582,462 | 4/1986 | Thiel | 411/371 |
| 4,593,546 | 6/1986 | Allen | 70/380 |
| 4,712,400 | 12/1987 | Steinbach | 70/369 |
| 4,723,428 | 2/1988 | Yamaguchi . | |
| 4,843,852 | 7/1989 | Foshee et al. | 70/367 |
| 4,881,391 | 11/1989 | Villa et al. . | |
| 5,295,377 | 3/1994 | Moricz et al. . | |
| 5,308,285 | 5/1994 | Malen et al. | 470/4 |

*Primary Examiner*—Steven N. Meyers
*Assistant Examiner*—Donald J. Lecher
*Attorney, Agent, or Firm*—Graham & James LLP

[57] ABSTRACT

A lock cylinder replacement device for replacing locks is inserted into a lock cylinder hole or sleeve after a lock cylinder is removed from the lock cylinder hole or sleeve. The lock cylinder replacement device includes a threaded bolt and a pan head portion. The lock cylinder replacement device may also include a rear fastening plate and a mounting nut for mating with the threaded bolt to secure the lock cylinder replacement device in the lock cylinder hole or sleeve.

20 Claims, 2 Drawing Sheets

LOCK CYLINDER REPLACEMENT DEVICE AND METHOD OF REPLACING LOCK CYLINDER WITH LOCK CYLINDER REPLACEMENT DEVICE

I. BACKGROUND OF THE INVENTION

A. Field of the Invention

The present invention relates to a lock cylinder replacement device and a method of replacing a lock cylinder with the lock cylinder replacement device and more specifically, to a lock cylinder replacement device for installation in a hole or sleeve, which originally contained a lock cylinder, after the lock cylinder has been removed from the hole or sleeve.

B. Description of the Prior Art

Over the past decade, the alarming rate of vehicle theft and theft from buildings has drastically increased the need for protection against theft of vehicles and other property. Several anti-theft devices have been introduced including alarm systems, steering wheel locks, vehicle disabling devices, vehicle tracking systems, etc. In addition, to prevent theft from buildings, several companies have hired security guards. However, many of these solutions are prohibitively expensive and/or ineffective in preventing theft.

Unauthorized access to vehicles and buildings is easily gained by using a skeleton key or other lock picking tools. In addition, there has been an increase in the number of vehicle thefts and thefts from buildings that are a result of stealing or copying keys.

Also, there is increased incentive to steal or copy a key because, if an ignition key for a vehicle can be obtained, the steering column does not have to be broken to allow access to the ignition wires for "hot-wiring" a vehicle or actuating rods and linkages located within the steering column that engage ignition switches and disengage steering wheel internal locks. Stolen vehicles with ignition keys are often more valuable and easier to sell because a vehicle identification number plate and vehicle title can be forged so that an unknowing purchaser of the stolen vehicle may not realize that the vehicle has been stolen. In addition, stolen vehicles with ignition keys are easier to sell more quickly because little or no repairs to the steering column or other parts of the car are necessary.

The key to a vehicle or a building or house is obtained and copied in several ways. Often, a parking valet or vehicle repair shop will have several vehicle keys and key rings containing house and building keys in one location. A thief can easily take one or more of the vehicle, building or house keys or make an imprint of the keys in an easily moldable material and later duplicate the keys from the imprint in the moldable material.

In addition, in most motor vehicles, a key used for starting the vehicle is also used for opening the vehicle doors and possibly the trunk. The lock cylinder located in the vehicle door or trunk can be easily removed. Once the lock cylinder has been removed from the vehicle door, anyone can easily and quickly make a key that operates the lock. The thief can then use the key to enter the vehicle, start the ignition and steal the vehicle.

Also, there are inexpensive tools that are widely available and can be used to make a key using the stolen lock cylinder which operates a lock. Further, if a vehicle has an alarm and a thief has the key to the ignition, the thief can override the alarm by activating the valet switch.

One prior art solution to this problem involves installing a steel plate, typically in the form of a triangle, rectangle or square, on a vehicle door so that the steel plate surrounds the lock. The steel plate installed on the vehicle door makes it difficult to remove the lock from the vehicle door. However, the steel plate must be attached to the vehicle door causing damage to the body of the vehicle and changing the appearance of the vehicle because of rivets that go through the door skin of the vehicle. This creates particular problems when a vehicle has been leased and the vehicle must be returned in its original form at the end of the lease. In addition, these steel plates attached to vehicle doors can be removed using a crowbar or other similar device.

Another prior art solution, described in U.S. Pat. No. 4,881,391 to Villa et al., involves the use of a movable cover for an automobile lock. However, this cover does not prevent access to the lock because the cover can be easily detached or moved to allow access to the lock.

In another prior art device, U.S. Pat. No. 5,295,377, to Moricz et al., an automobile lock includes latch plates which are partially expelled from the lock cylinder when the key is removed from the lock cylinder. The lock of Moricz et al. prevents a lock from being broken open by a screw driver or other tool. However, this lock does not prevent a duplicate key from being used to open the lock or prevent the lock cylinder from being removed from the door.

SUMMARY OF THE INVENTION

The present invention solves the above-described problems with conventional locks. More specifically, a preferred embodiment of the present invention provides a lock cylinder replacement device that may be installed in remote activated lock systems contained in vehicles, houses, and other locking structures.

The lock cylinder replacement device of the present invention ensures that the only way a locked door or structure can be opened is via a remote lock activation device called a keyless entry now standard on most late model vehicles and used in several residential and commercial buildings. The lock cylinder replacement device also prevents a door lock from being used to duplicate an entry key or ignition key.

In a preferred embodiment of the lock cylinder replacement device, the lock cylinder replacement device is preferably formed of a solid body portion which has a shape that corresponds to the shape of the lock cylinder hole or sleeve formed in a door. The lock cylinder replacement device may be formed of hardened steel, metal and any other suitable materials. The lock cylinder replacement device also includes a pan head that covers the lock cylinder hole or sleeve. The pan head lies substantially flat against the surface of a wall or structure surrounding the lock cylinder hole or sleeve.

In another embodiment of the present invention, a method is provided for removing a lock cylinder from a lock cylinder hole or sleeve and installing a lock cylinder replacement device in the lock cylinder hole or sleeve.

The lock cylinder replacement device according to the present invention provides several advantageous results. The lock cylinder replacement device can be quickly and easily installed and prevents anyone from picking a lock or duplicating a door key to gain access to a building or obtain an ignition key based on a vehicle door lock. In addition, it prevents a structure or door from being opened except for by an authorized remote control device to prevent use of skeleton keys, lock picks, and unauthorized or stolen keys to open a lock.

Further, the lock cylinder replacement device has a minimal effect on the appearance of the surface surrounding the lock housing and does not permanently damage or alter the surrounding surface. Thus, if a vehicle has been leased and must be returned in original form at the end of the lease, the lock cylinder replacement device can be removed and the original lock can be reinstalled in the vehicle door.

Other features and advantages of the present invention will become apparent from the following description of the invention which refers to the accompanying drawings.

BRIEF DESCRIPTION OF THE DRAWINGS

For the purpose of illustrating the invention, there is shown in the drawings an embodiment which is presently preferred; it being understood, however, that the invention is not limited to the precise arrangements and instrumentalities shown.

DETAILED DESCRIPTION OF THE INVENTION

Figure 1:
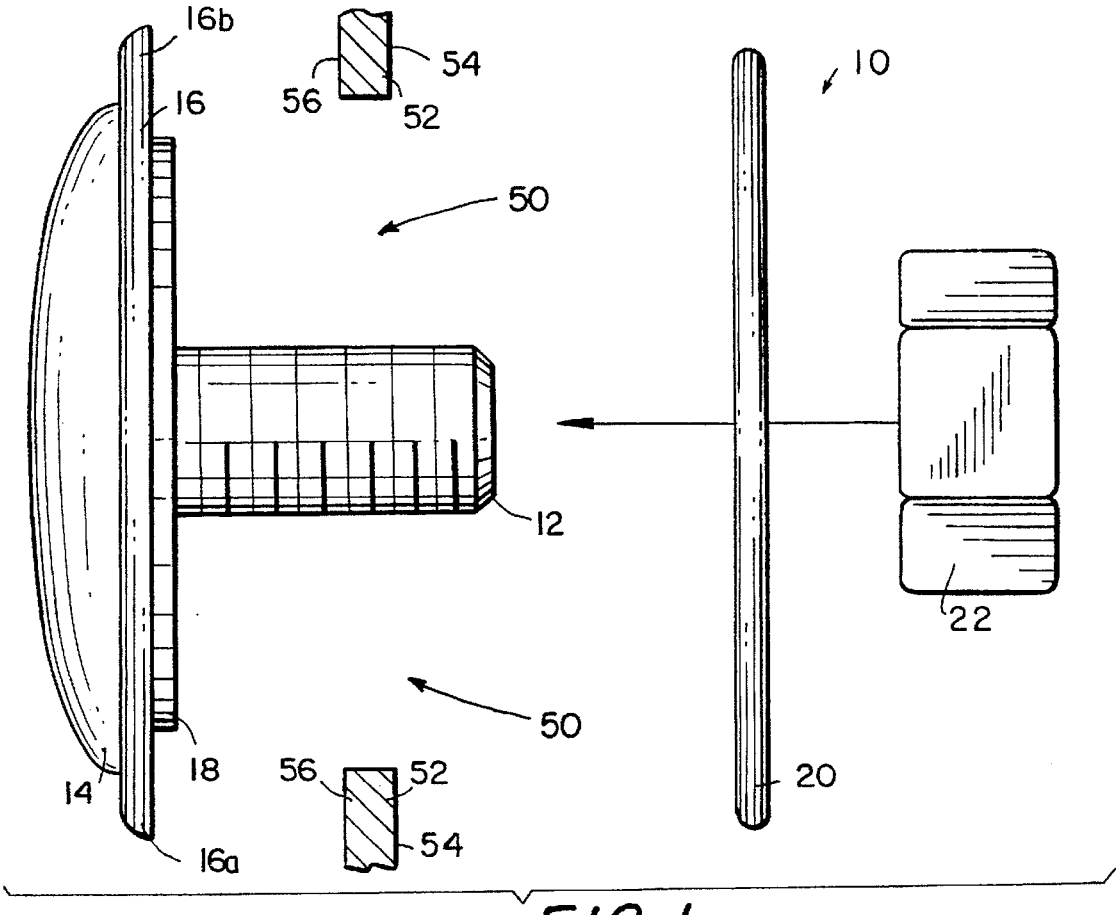
FIG. 1 is a side view of a lock cylinder replacement device in accordance with a preferred embodiment of the present invention.

Referring now to the drawings wherein like numerals indicate like elements, there is shown in FIG. 1 a preferred embodiment of a lock cylinder replacement device 10 according to the present invention. The lock cylinder replacement device 10 is installed in a lock cylinder hole or sleeve 50 after a lock cylinder has been removed from the lock cylinder hole or sleeve 50. The lock cylinder hole or sleeve 50 is typically formed in a wall 52, such as a vehicle door skin or building door skin. The wall 52 includes an interior surface 54 and an exterior surface 56.

The lock cylinder replacement device 10 includes a lag or bumper bolt 12 which has a shallow pan head 14 and a flange 16. The shallow pan head 14 is preferably formed to have a diameter that is equal to or slightly larger than a diameter of the hole 50. The flange 16 is formed to have a diameter that is larger than the diameter of the hole to prevent the lock cylinder replacement device 10 from being pulled through the hole 50. That is, the flange 16 ensures that the lock cylinder replacement device 10 is properly positioned on the exterior surface 56 of the wall.

The configuration of the pan head 14 prevents the lock cylinder replacement device 10 from protruding excessively from the exterior surface 56 of the wall 52. The flange 16 preferably has a sloped peripheral portion **16*a* to prevent a tool, such as a screwdriver, from being inserted between the flange 16 and the exterior surface 56 of the wall 52. Because of the flange 16, the lock cylinder replacement device 10 cannot be forcibly removed from the wall 52**.

A countersunk rim 18 may possibly be provided on the lock cylinder replacement device 10. The diameter of the countersunk rim 18 may be formed to be slightly less than the diameter of the hole 50 so that the countersunk rim 18 performs a positioning function for accurately locating the lock cylinder replacement device 10 within the hole 50.

To fixedly secure the lock cylinder replacement device 10 to the wall 52, a rear fixing member 20, preferably in the form of a washer or support bracket is located on the bolt 12 adjacent the interior surface 54 of the wall 52. The rear fixing member 20 is preferably formed to have a hole formed therein. The hole in the fixing member 20 has a diameter that is slightly larger than the diameter of the bolt 12. The bolt 12 threadedly engages with a mounting nut 22 which is tightened to secure the replacement device 10 to the wall 52. Once the cooperating nut 22 has been tightened on the bolt 12, the lock cylinder replacement device 10 cannot be removed from the exterior surface of the wall 52. In fact, it is far more difficult to remove the lock cylinder replacement device 10 from a door skin than it is to remove the original lock cylinder. Therefore, the only access to the interior side of the wall, i.e. the vehicle or building interior, is via use of a remote control lock actuator.

In the case of a vehicle, even if the lock cylinder replacement device 10 is somehow forcibly removed from the door, copying of the ignition key is impossible because the lock is no longer located in the vehicle door. Furthermore, the lock cylinder replacement device 10 can be easily replaced with the original lock, i.e. a vehicle door lock, by unfastening the bolt 12 and nut 22 and then re-installing the original lock in the lock hole or sleeve 50.

In a preferred embodiment, the entire lock cylinder replacement device 10 except for the threaded shaft of the bolt 12 is dipped in a rubber coating material, such as Plastic Dip™. After the lock cylinder replacement device 10 is dipped in the rubber coating material, it is air dried, preferably immediately using a gentle air flow so as to form a rubberized skin around the bolt head 14, flange 16 and flange portion **16*a* and rim 18 (if included). The rubberized skin around the lock cylinder replacement device 10 except the threaded shaft prevents the lock cylinder replacement device from being exposed to and corroded by the environment. In addition, the rubberized skin around the lock cylinder replacement device 10 allows the flange 16 and peripheral portion 16*a* to fit snugly in the recess 50 to ensure proper positioning and secure fit of the lock cylinder replacement device 10 within the door skin 52**.

The rubberized skin on the lock cylinder replacement device 10 can be black so as to match the black trim used on most vehicles. Alternatively, the rubberized skin may be colored according to the demands of the wall 52 on which the replacement device is mounted. If a rubberized skin is not used, the bolt head 14, flange 16 and rim 18 can be galvanized and/or painted with rust preventing paint according to a desired color.

The lock cylinder replacement device 10 is formed so as to fit within and cover the diameter of a standard lock cylinder so that the wall 52 does not have to be structurally changed to accommodate the replacement device 10. In addition, as mentioned above, the lock cylinder replacement device 10 can be easily installed and removed without any damage to the wall 52.

In a preferred embodiment, the entire body of the lock cylinder replacement device 10, including the bolt 12, the countersunk rim 18, the flange 16 and the head 14 is cast to form a single piece component to maximize the strength of the lock cylinder replacement device. This single piece component forming the lock cylinder replacement device is preferably galvanized to resist corrosion.

A preferred embodiment of a method of replacing a lock with the lock cylinder replacement device 10 will now be described. A lock cylinder that is located in a wall of a vehicle door, a building door, or other structure containing a lock, is removed. Typically, an outer casing of a lock is threadedly or force-fittingly engaged in a recess 50 formed in the wall 54. Once the lock cylinder has been removed, the lock cylinder replacement device 10 can be installed.

The wall 52 should preferably be positioned such that both the exterior surface 56 and the interior surface 54 are accessible. The bolt 12 is inserted into the lock cylinder hole or sleeve 50. The replacement device 10 is moved to a position at which the countersunk rim 18 is located within the hole 50 and the flange 16 is flush against the surface of the exterior surface 56 of the wall 54. The washer or support bracket 20 is mounted on the bolt 12 and then, the mounting nut 22 is threadedly engaged on the threaded bolt 12 and tightened.

Figure 3:
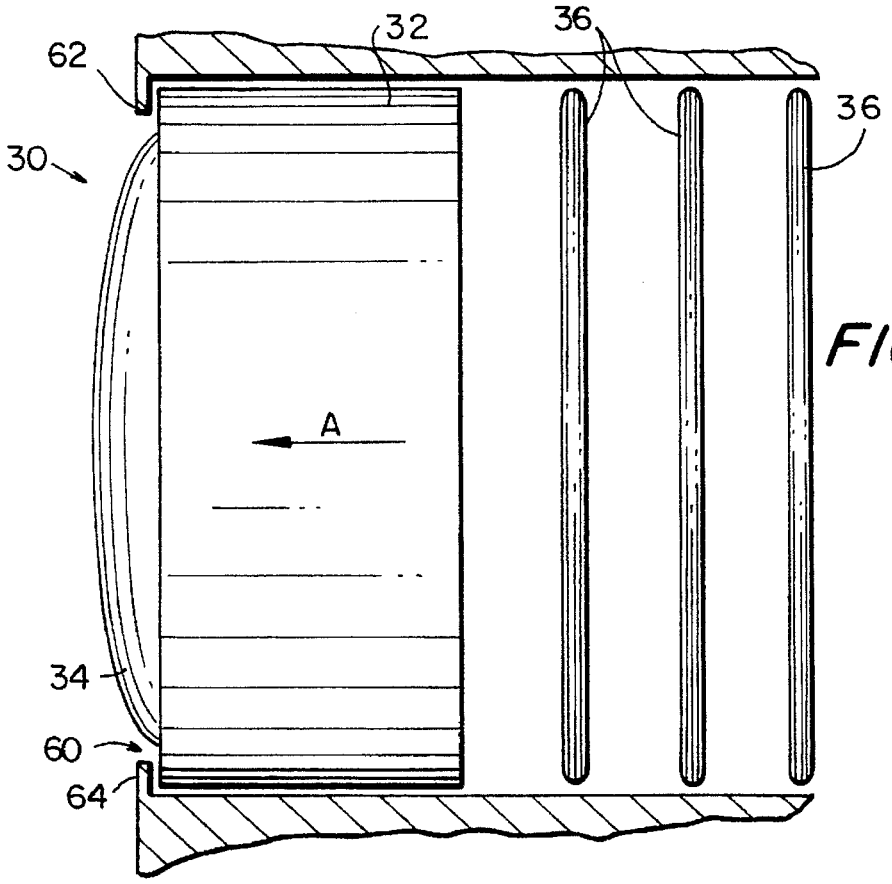
FIG. 3 is a side view of an alternative embodiment of the lock cylinder replacement device.
Figure 4:
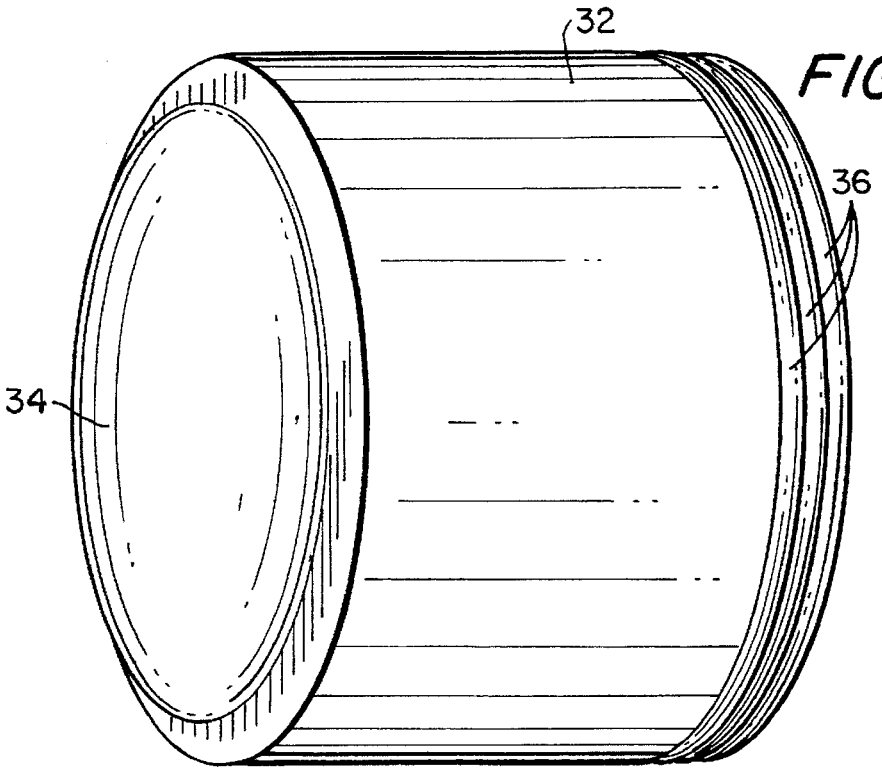
FIG. 4 is a perspective view of the alternative embodiment of the lock cylinder replacement device shown in FIG. 3.

FIGS. 3 and 4 illustrate an alternative embodiment of the lock cylinder replacement device of the present invention. The lock cylinder replacement device 30 shown in FIGS. 3 and 4 is designed for use with a lock contained in a handle of a door, such as a vehicle door handle. The lock cylinders in such handles are designed to be easily removed.

Figure 2:
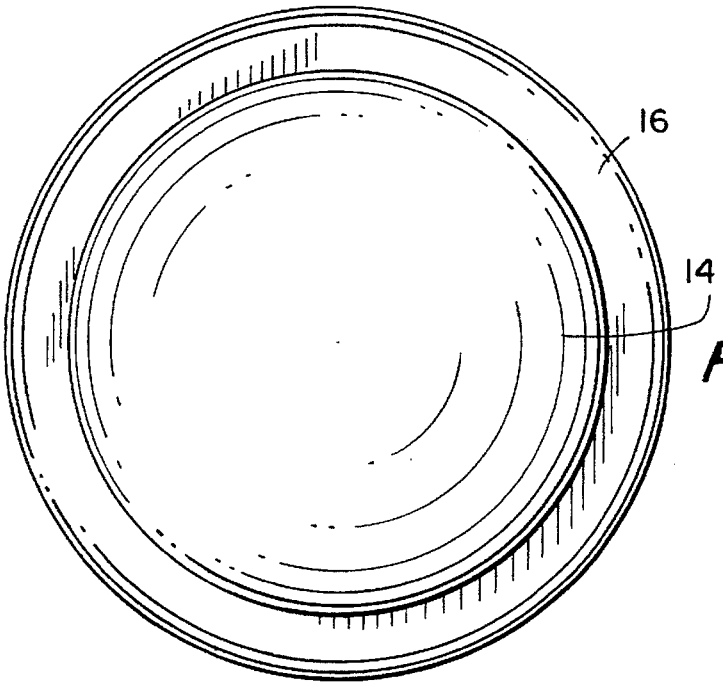
FIG. 2 is a front view of the lock cylinder replacement device shown in FIG. 1.

As shown in FIG. 3, after a lock cylinder in the door handle has been removed from a door handle recess 60, a lock cylinder replacement device 30 is installed. A bumper bolt or body portion 32 of the lock cylinder replacement device 30 may be of a different size than that shown in FIGS. 1 and 2. The bumper bolt 32 of the lock cylinder replacement device 30 is used to replace the lock cylinder removed from the handle.

In a preferred embodiment, the head 34 of the bumper bolt 32 is formed of stainless steel, aluminum or some other suitable material which will not rust. The body portion 32 has a shape corresponding to the shape of the recess 60 in the handle. Because the depth of the recess 60 varies according to a particular handle, it may be necessary to insert spacing members 36, such as washers, in the recess 60 to secure the lock cylinder replacement device 30 within the recess 60.

After the original lock cylinder has been removed from the recess 60, the lock cylinder replacement device is inserted in the recess 60 in the direction of arrow A in FIG. 3. Then, the spacing members 36 are inserted into the recess 60, if necessary, to ensure that the replacement device 30 fits securely within the recess. The lock cylinder replacement device 30 is held within the recess 60 by retaining members 62, 64 of the lock cylinder housing. The recess 60 may be threaded and the bolt 32 may be formed with a corresponding thread so as to threadedly engage with the threads of the recess 60.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. In combination, a door, a lock cylinder hole located in the door and a lock cylinder replacement device for replacing a lock cylinder removed from the lock cylinder hole in the door, the lock cylinder replacement device comprising:

a body portion having a shape corresponding to a shape of the lock cylinder hole;

a head portion connected to the body portion and having a shape to cover the lock cylinder hole, the head portion including a continuous outer surface which lacks an opening formed thereon;

a securing device for securing the lock cylinder replacement device in the lock cylinder hole.

2. The combination of claim 1, wherein the securing device comprises a support bracket and a nut.

3. The combination of claim 2, wherein the body portion comprises a threaded member and the nut is threadedly engaged on the threaded member.

4. The combination of claim 1, further comprising a flange connected to the head portion.

5. The combination of claim 1, further comprising a countersunk rim connected to the body portion.

6. The combination of claim 1, further comprising a flange having a sloped peripheral edge.

7. The combination of claim 1, wherein the body portion and the head portion comprise a single piece member.

8. The combination of claim 7, wherein the single piece member is a cast metal member.

9. The combination of claim 1, further comprising a countersunk rim, a flange having a sloped peripheral edge and wherein the body portion, the head portion, the countersunk rim and the flange comprise a single piece member.

10. The combination of claim 9, wherein the single piece member is a cast metal member.

11. The combination of claim 1, wherein the head portion has a rubberized skin formed thereon.

12. The combination of claim 1, wherein at least one of the head portion and the body portion is made of galvanized and hardened steel.

13. The combination of claim 1, further comprising a plurality of spacer members located adjacent to the body portion in the lock cylinder hole.

14. The combination of claim 1, wherein the body portion is formed to fill substantially all of the lock cylinder hole.

15. A method of replacing a lock cylinder located in a lock cylinder hole in a door with a lock cylinder replacement device, the method comprising the steps of:

obtaining a lock cylinder replacement device including a body portion having a shape corresponding to a shape of the lock cylinder hole, a head portion connected to the body portion and having a shape to cover the lock cylinder hole, the head portion including a continuous outer surface which lacks an opening formed thereon and a securing device;

removing the lock cylinder from the lock cylinder hole located in the door;

inserting the body portion of the lock cylinder replacement device into the lock cylinder hole located in the door; and mounting the securing device one of on the body portion of the lock cylinder replacement device and in the lock cylinder hole to securely fasten the lock cylinder replacement device in the lock cylinder hole in the door.

16. The method of claim 15, wherein the securing the device comprises a nut, wherein the body portion and the nut are threaded and the step of mounting the securing device includes a step of adjusting the securing device relative to the body portion by rotating one of the nut and the body portion relative to other of the nut and the body portion to securely locate the lock cylinder replacement device in the lock cylinder hole.

17. The method of claim 15, wherein the lock cylinder hole and the body portion are threaded and the step of inserting the body portion of the lock cylinder replacement device into the lock cylinder hole includes the step of rotating the body portion relative to the lock cylinder hole to securely locate the body portion within the lock cylinder hole.

18. The method of claim 17, wherein the step of rotating the body portion relative to the lock cylinder hole includes the step of rotating the body portion relative to the lock cylinder hole until the head portion of the lock cylinder replacement device engages an outer surface of a structure surrounding the lock cylinder hole.

19. The method of claim 17, wherein the lock cylinder replacement device includes a countersunk rim and the step of rotating the body portion relative to the lock cylinder hole includes the step of rotating the body portion relative to the lock cylinder hole until the countersunk rim is located within the lock cylinder hole.

20. The method of claim 15, wherein the step of mounting the securing device comprises the step of inserting spacing members between the body portion of the lock cylinder replacement device and the lock cylinder hole.

* * * * *